US007240721B2

(12) United States Patent
Yan et al.

(10) Patent No.: US 7,240,721 B2
(45) Date of Patent: Jul. 10, 2007

(54) ASSEMBLY AND METHOD OF RADIANT/STRUCTURAL FLOOR SYSTEM

(76) Inventors: Hong Yan, 2508 Toronto Cr. NW., Calgary, Alberta (CA) T2N 3V9; Hongge Wang, 117 Millview Park SW., Calgary, Alberta (CA) T2Y 3Y2

( * ) Notice: Subject to any disclaimer, the term of this patent is extended or adjusted under 35 U.S.C. 154(b) by 554 days.

(21) Appl. No.: 10/314,087

(22) Filed: Dec. 9, 2002

(65) Prior Publication Data

US 2003/0173057 A1 Sep. 18, 2003

(30) Foreign Application Priority Data

Mar. 12, 2002 (CA) ..... 2375641

(51) Int. Cl.
*F24D 3/16* (2006.01)
*F24D 5/10* (2006.01)

(52) U.S. Cl. ..... 165/56; 165/53; 126/271.1; 237/1 R

(58) Field of Classification Search ..... 165/47, 165/53, 56; 126/271.1; 237/1 R
See application file for complete search history.

(56) References Cited

U.S. PATENT DOCUMENTS 2,184,113 A * 12/1939 Calafati ..... 165/56
2,240,951 A * 5/1941 Hamjy ..... 165/49
2,505,622 A * 4/1950 Mckee ..... 237/1 R
2,512,854 A * 6/1950 Edgerly ..... 165/56
2,598,842 A * 6/1952 Scott ..... 165/56
2,644,790 A * 7/1953 Harper et al. ..... 210/150
2,726,593 A * 12/1955 Lahti ..... 165/56
3,727,538 A * 4/1973 Jacobson, Jr. ..... 165/53
3,779,150 A * 12/1973 Sproul, Sr. ..... 52/302.3
3,795,272 A * 3/1974 Kahn et al. ..... 165/54
3,818,892 A * 6/1974 Von Kohorn ..... 165/47
3,903,958 A * 9/1975 Hay ..... 165/50
3,994,278 A * 11/1976 Pittinger ..... 165/53
4,082,080 A * 4/1978 Pittinger ..... 165/236
4,146,221 A * 3/1979 Newquist et al. ..... 165/53
4,186,795 A * 2/1980 Platell ..... 165/53
4,203,487 A * 5/1980 Gartner ..... 165/53
4,216,762 A * 8/1980 Klaila ..... 52/168

(Continued)

FOREIGN PATENT DOCUMENTS

CA 2375641 9/2003

(Continued)

*Primary Examiner*—Ljiljana Ciric

(57) ABSTRACT

A floor system that combines a radiant in-floor heating system with a structural floor system using heated air as an energy source and sealed floor panels as radiant bodies. Hot air circulates internally throughout the sealed floor system heating metal joists, a radiant metal sheet, the structural sub-floor, the interior floor surface and objects within the living space above. Hot air is directed from a furnace through a duct and into arranged airflow pathways within the sealed floor system before returning to the furnace via a duct for reheating. The arranged airflow pathways are created by parallel metal joists, the structural sub-floor on the top of the metal joists, an enclosed board at the bottom of the metal joists and wood rim boards. The sealed floor system is prefabricated as modular panels and delivered to the construction site. There are three types of panels: (i) a utility floor panel for connecting the ducts to and from the furnace, (ii) a standard floor panel for mass production and (iii) an end floor panel for special layout requirements.

7 Claims, 5 Drawing Sheets

U.S. PATENT DOCUMENTS

| | | | | | |
|---|---|---|---|---|---|
| 4,279,244 | A | * | 7/1981 | McAlister | 126/621 |
| 4,290,247 | A | * | 9/1981 | Alderman | 165/53 |
| 4,459,973 | A | * | 7/1984 | Royer | 165/47 |
| 4,896,831 | A | * | 1/1990 | Choi | 165/53 |
| 5,392,846 | A | * | 2/1995 | Gardner | 165/53 |
| 5,577,554 | A | * | 11/1996 | Umina | 165/53 |
| 5,811,758 | A | * | 9/1998 | Choi | 219/213 |

FOREIGN PATENT DOCUMENTS

| | | |
|---|---|---|
| DE | 3245889 | 6/1984 |
| FR | 2777071 | 10/1999 |
| JP | 06-300350 | 10/1994 |
| JP | 2002-257371 | 9/2002 |
| WO | WO 00/46457 A1 | 8/2000 |

* cited by examiner

ASSEMBLY AND METHOD OF RADIANT/STRUCTURAL FLOOR SYSTEM

CROSS REFERENCE TO RELATED APPLICATIONS

This application is related to and claims priority, under 35 U.S.C. 119, to Canadian Patent Application No. 2,375,641 filed on Mar. 12, 2002. The entire contents of Canadian Patent Application No. 2,375,641 are hereby incorporated by reference herein.

The Applicants note the following United States patents cited by the USPTO Examiner:

| Document Number Country Code-Number-Kind Code | Date MM-YYYY | Name | Classification |
|---|---|---|---|
| U.S. Pat. No. 3,818,892 | 06-1974 | Von Kohorn, Henry | 165/47 |
| U.S. Pat. No. 2,726,593 | 12-1955 | Lahti, Anard A. | 165/56 |
| U.S. Pat. No. 2,512,854 | 06-1950 | Edgerly, F. H. | 165/56 |
| U.S. Pat. No. 2,184,113 | 12-1939 | Calafati, Salvator S. | 165/56 |

The Applicants also note the following foreign patents cited by the Canadian Intellectual Patent Office Examiner:

| Publication Number | Date | Name | International Patent Classification |
|---|---|---|---|
| PCT 00/46457 | Aug. 10, 2000 | Thorstensson | E04B 5/48 |
| 6300350 | Oct. 28, 1994 | Kawagoe | F24F 13/02 |
| 3245889 | Jun. 14, 1984 | Stoeckhert | E04B 5/48 |
| 2 777 071 | Oct. 8, 1999 | Bernier | F24F 13/02 |
| 2002257371 | Sep. 11, 2002 | Suganuma | F24D 19/00 |

BACKGROUND OF THE INVENTION

Radiant in-floor heating is widely regarded as the most comfortable, healthiest and most natural heating process available. Thousands years ago ancient Romans discovered radiant in-floor heating by introducing hot air directly from a wood fired furnace into the chambers underneath the floor. The crude wood fired in-floor systems developed by ancient Romans are no longer used because they are inefficient and unsafe.

The modern popular radiant in-floor heating systems utilise hot fluids circulating through the tubes (hydronic systems) or electric current through cables (electrical resistance systems) installed in concrete slabs or attached to the subfloor and covered with a pourable gypsum floor underlayment. Hot fluids circulating through the tubes or electrical resistance in the cables warm the underlayment and the floor covering above. The floors never become hot, just pleasantly warm. Hydronic and electrical resistance systems, however, have the disadvantages of high capital and installation costs, potential construction delays resulting from the co-ordination of specialty subcontractors and the difficulty and high cost involved in maintenance and repair. Consequently, such systems have not flourished in the residential housing market.

It is difficult to find any radiant in-floor heating systems in the present market that use hot air as the heating medium. Further, the prior arts of in-floor radiant heating systems based on heated air suffer from inefficiencies in absorbing heat from hot air and distributing heat uniformly across the entire floor surface.

The present invention relates in general to a radiant in-floor heating system using heated air as an energy source circulating inside of a sealed floor system. Specifically, the present invention relates to a radiant in-floor heating system built into a structural floor system that is specifically constructed using metal joists and a radiant metal sheet.

SUMMARY OF THE INVENTION

The present invention provides an improved radiant in-floor heating system that employs a simple and effective structure to overcome the complexity, inefficiencies and cost disadvantages of existing in-floor heating systems and prior art utilizing hot air.

The present invention provides an optimal hot airflow pathway to improve heating efficiency. Hot air from a furnace flows into one end of the sealed structural floor system. Hot air is directed by arranged airflow pathways throughout the entire heating zone and then directed back to the furnace for reheating via an air return duct. Throughout the entire heating zone, energy (heat) is absorbed by the structural metal joists and radiant metal sheet, and then released uniformly across the entire floor warming the structural sub-floor, the floor surface and the objects within the living space above.

The present invention combines a radiant in-floor heating system with a structural floor system. The floor system panels are constructed using a plurality of metal joists, preferably cold-formed metal joists, installed parallel to each other. The structural metal floor joists are a major structural component for forming the building floor and also function as a thermal component of a radiant in-floor heating system to absorb, reserve and conduct heat. The metal sheet underneath the sub-floor functions as a thermal component to absorb, conduct and release heat in the radiant in-floor heating system. The layer of thermal insulation on the top of the enclosure board directs heat upwards to increase the efficiency of radiation.

The floor system panels are sealed by (i) the structural sub-floor on the top of the metal joists, (ii) the enclosure board at the bottom of the metal joists and (iii) metal joists or wooden rim boards on the sides. Hot air circulation is kept within the sealed structural floor system, thus eliminating drafts and dust blown into the living space.

The structural sub-floor and the enclosure board also provide structural bracing for the metal joists, thus eliminating the need for joist braces that would otherwise be required for on-site construction using metal joists. Consequently, the present invention reduces floor construction complexity and installation time.

The sealed structural floor system can be prefabricated and modularized providing flexibility to match any building design layout and increase productivity. The floor system is prefabricated as panels and delivered to the construction site, thus reducing on site construction time. There are three types of panels: (i) utility floor panel for connecting the ducts to and from the furnace, (ii) standard floor panel for mass production and (iii) end floor panel for special layout requirements.

BRIEF DESCRIPTION OF THE DRAWINGS

The drawings to be read in conjunction with the specification are described below.

DETAILED DESCRIPTION OF THE INVENTION

Figure 1:
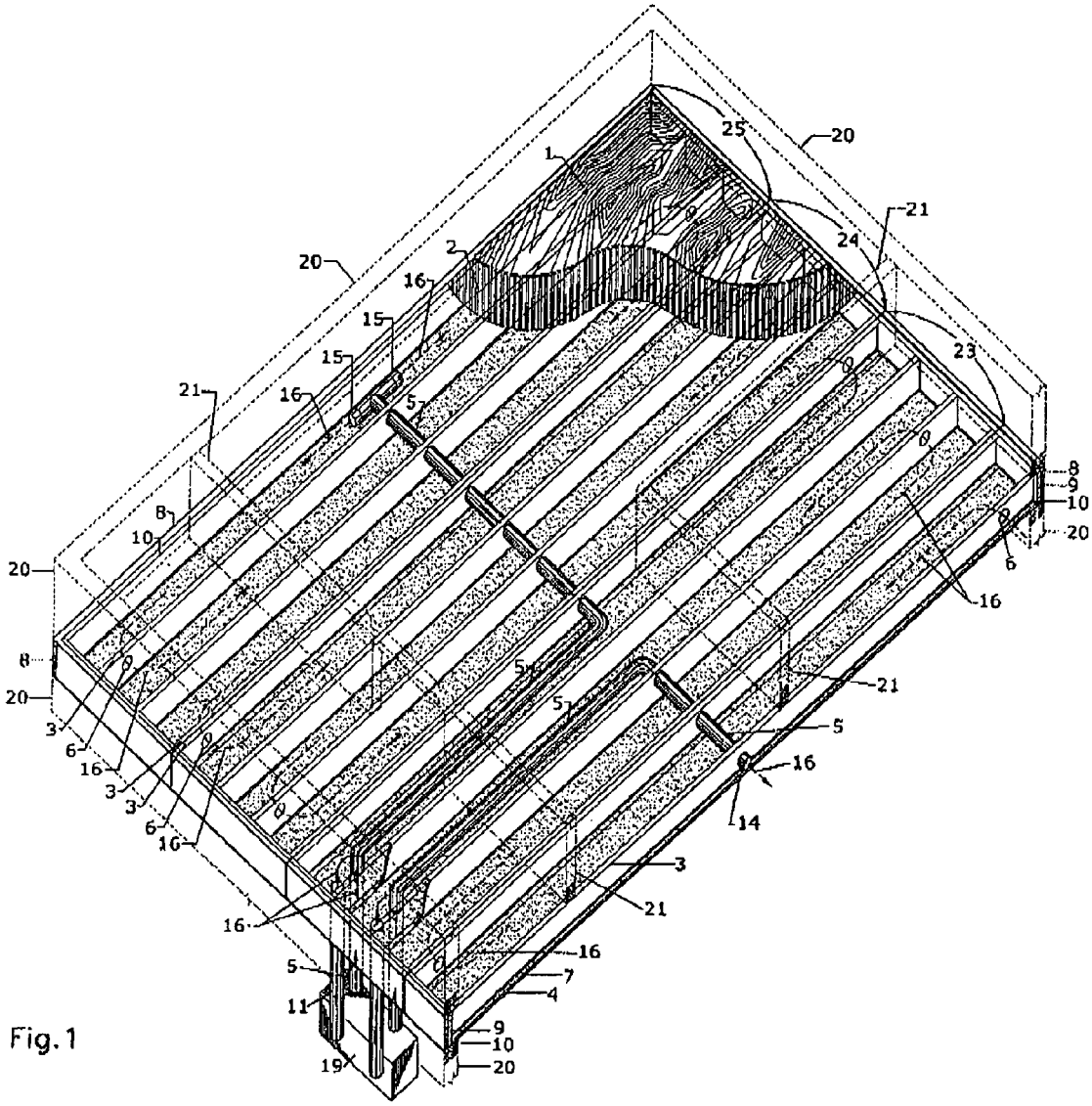
FIG. 1 is a fragmentary isometric view showing the floor system in accordance with the invention.

As shown in FIG. 1, a sealed floor unit system is constructed with a plurality of metal joists (3) and floor system components comprised of a metal sheet (2) attached to the bottom of a structural sub-floor (1) as the top enclosure, wood rim boards (8) with edge insulation and a metal rim joist (10) as side enclosures, and an enclosure board (4) with an insulation layer (7) on its top as the bottom enclosure. The metal joists (3) with air circulation openings (6) and the above noted floor system components are arranged in such way as to form an internal airflow pathway for the purposes of directing the circulation of heated air supply (16) and the convection of energy (heat) within the cavities of the sealed floor panel, both for radiant in-floor heating.

As seen in FIG. 1, the metal joists (3) are major structural components for forming the floor panel system that supports the building floor and walls (20, 21) above the floor. The metal joists (3) also function as integral thermal component of the radiant in-floor heating system by absorbing, storing and conducting heat. Also as seen in FIG. 1, a radiant metal sheet (2) underneath the structural sub-floor (1) functions as a integral thermal component of the radiant heating system for absorbing, conducting and releasing energy (heat) from heated air and heated metal joists (3). The radiant metal sheet (2) is directly connected to the metal joists (3), which allows for efficient heat transfer from metal joists (3) to the metal sheet (2). The thermal properties and designed use of the metal joists (3) and metal sheet (2) result in a uniform warming of the floor surface and the room above.

As seen in FIG. 1, the structural sub-floor (1) and the enclosure board (4) provide structural bracing for the metal joists (3), thus eliminating the need for joist braces that would otherwise be required for on-site construction using metal joists.

As seen in FIG. 1, an internal airflow pathway formed within the cavities of the sealed floor system. That internal airflow pathway is supplied with hot air by an air supply duct (5) and an air supply head (15). The air supply duct (5) is extended to the furthest end of a sealed floor panel thus maximising coverage of the floor structure and optimising heating efficiency. Air circulation openings (6) are positioned at alternate ends of successive metal joists (3) creating a one-way air flow direction (16) for the internal airflow pathway.

The means of radiant in-floor heating comprises directing heated air supply along the defined air flow direction (16) inside of the sealed floor system; using metal joists (3) as thermal components for absorbing, conducting and storing energy (heat) from heated air; and using a radiant metal sheet (2) attached to the bottom of the sub-floor (1) as thermal component for absorbing, conducting and releasing energy (heat) from heated air and heated metal joists (3). This radiant in-floor heating system uniformly warms floor surface and room above.

As shown in FIG. 1, the floor system can be pre-fabricated and modularised as panels. There are three types of panels: (i) a utility floor panel (23), a standard floor panel (24) and an end floor panel (25). Pre-fabrication of the panels reduces on-site construction time and costs. Modularised into panels with specific design purposes maximises flexibility to match any building floor plan layout.

Figure 2:
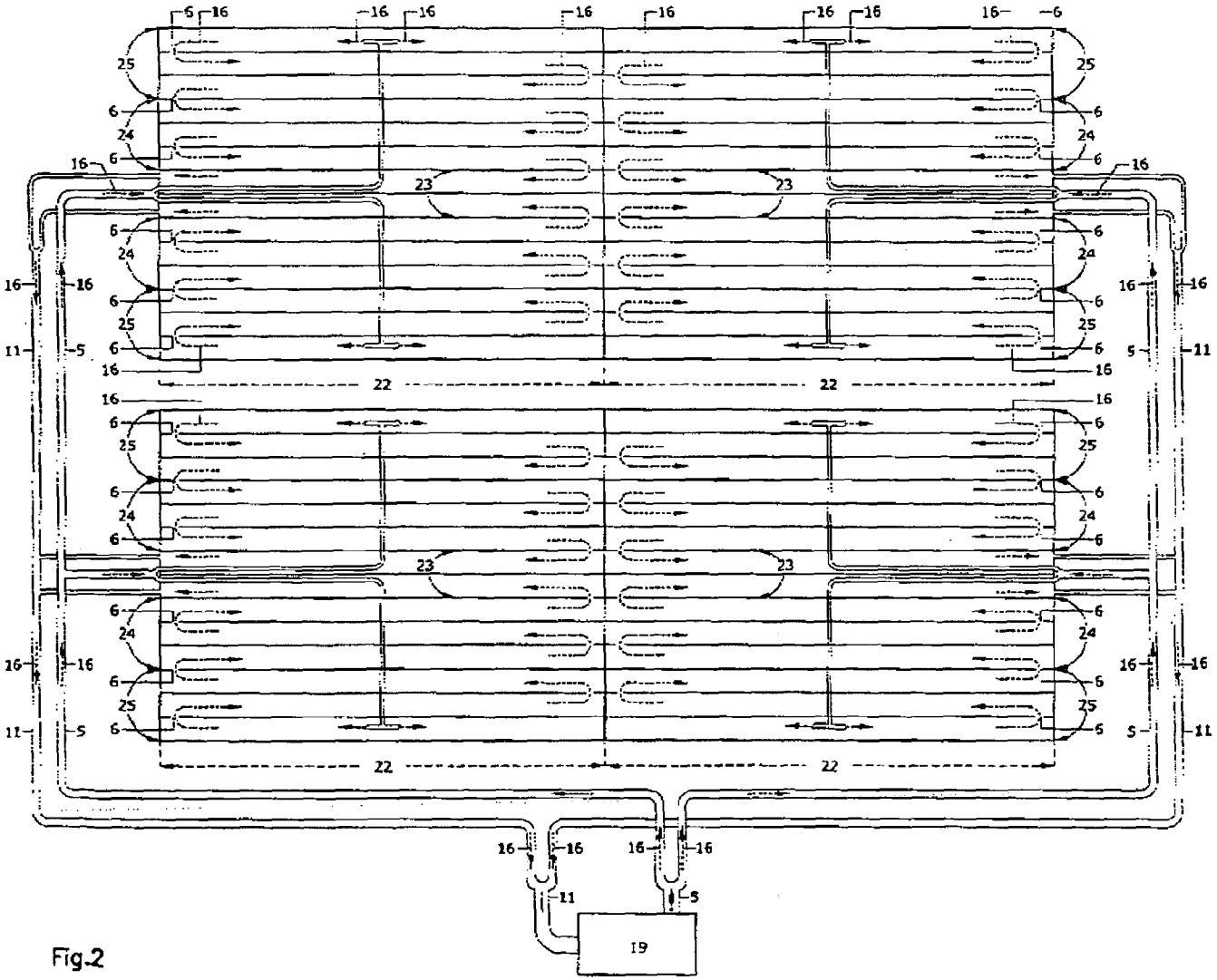
FIG. 2 is a schematic diagram of air flow direction within the radiant in-floor heating system arranged in multiple heating zone layout in accordance with the invention.

The airflow pattern schematic diagram (FIG. 2) illustrates the hot air flow direction (16) from the furnace (19) into one end of the sealed floor system and directed along the arranged airflow pathways through the entire heating zone (22), then through an air return duct (11) back to the furnace (19) for re-heating. FIG. 2 also illustrates a floor panel layout using utility floor panels (23), standard floor panels (24) and end floor panels (25) arranged in a multiple heating zone layout (22) for discreet heating control within different rooms or on different floors of a building. Aligned air circulation openings (6) in adjacent panels connect to form a continuous, internal airflow pathway from one panel to the next panel.

Figure 3A:
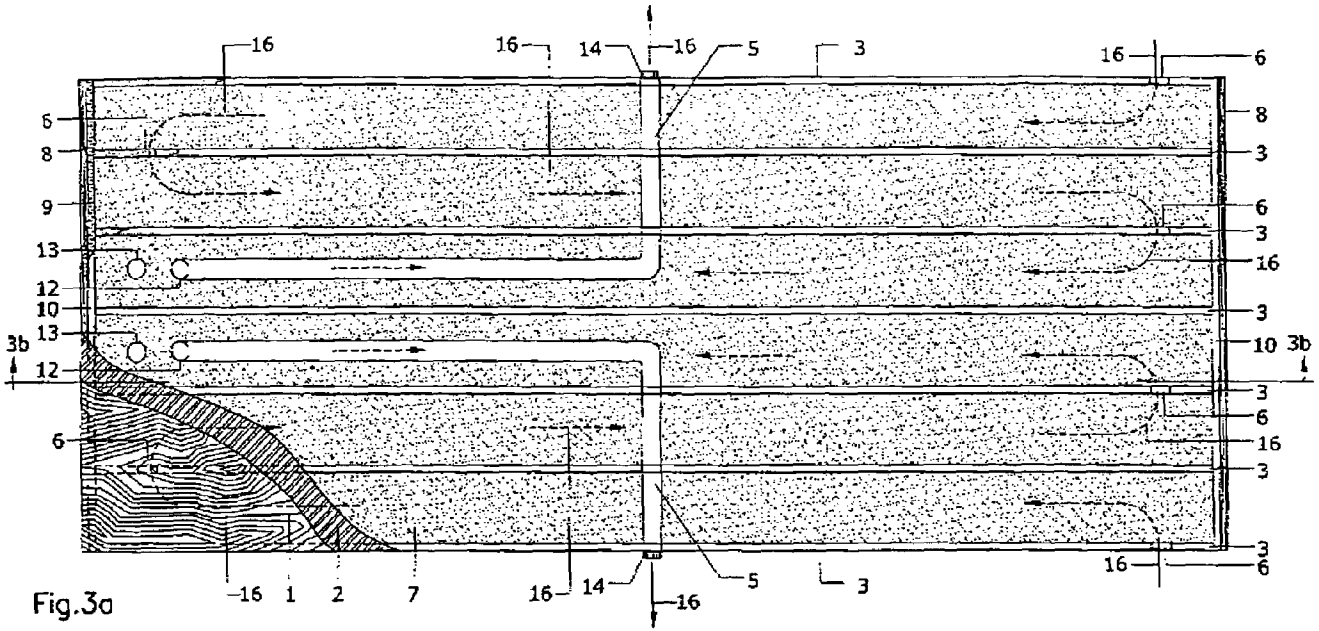
FIG. 3*a* is a fragmentary top plan view showing a utility floor panel assembly in accordance with the invention.
Figure 3B:
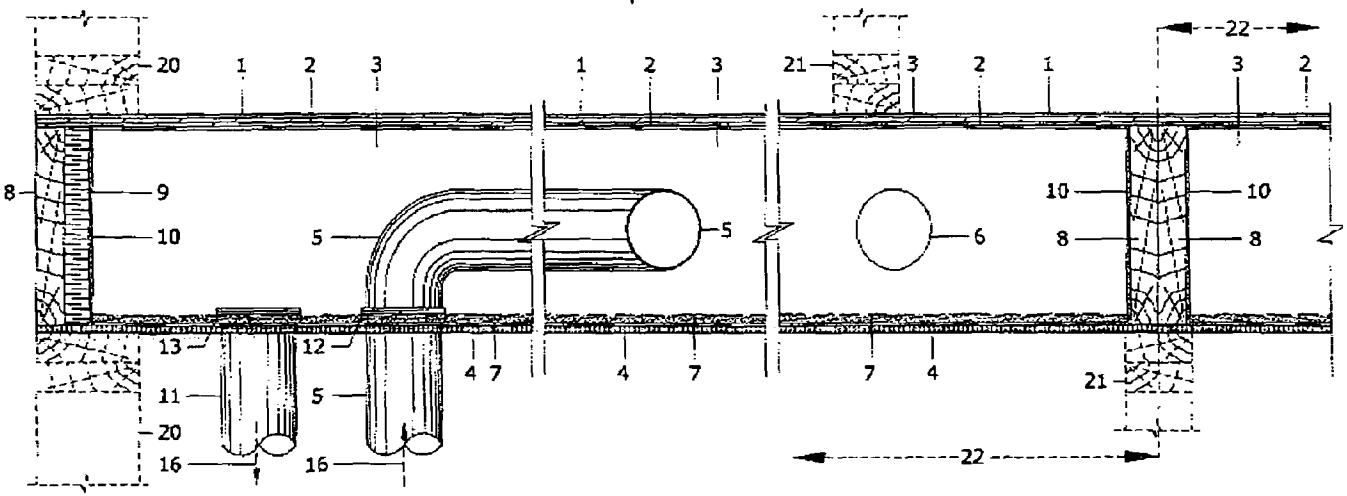
FIG. 3*b* is a fragmentary longitudinal sectional view showing a utility floor panel assembly in accordance with the invention.

As shown in FIGS. 3*a* and 3*b*, an air supply connection (12) and an air return connection (13) set at the bottom of the utility floor panel provide the joints to hook up the air supply duct (5) and air return duct (11), respectively, from and to the furnace. The air supply connection (12) and air return connection (13) can be installed at various locations on the bottom of utility floor panel, thus providing greater flexibility for the furnace location.

Figure 4A:
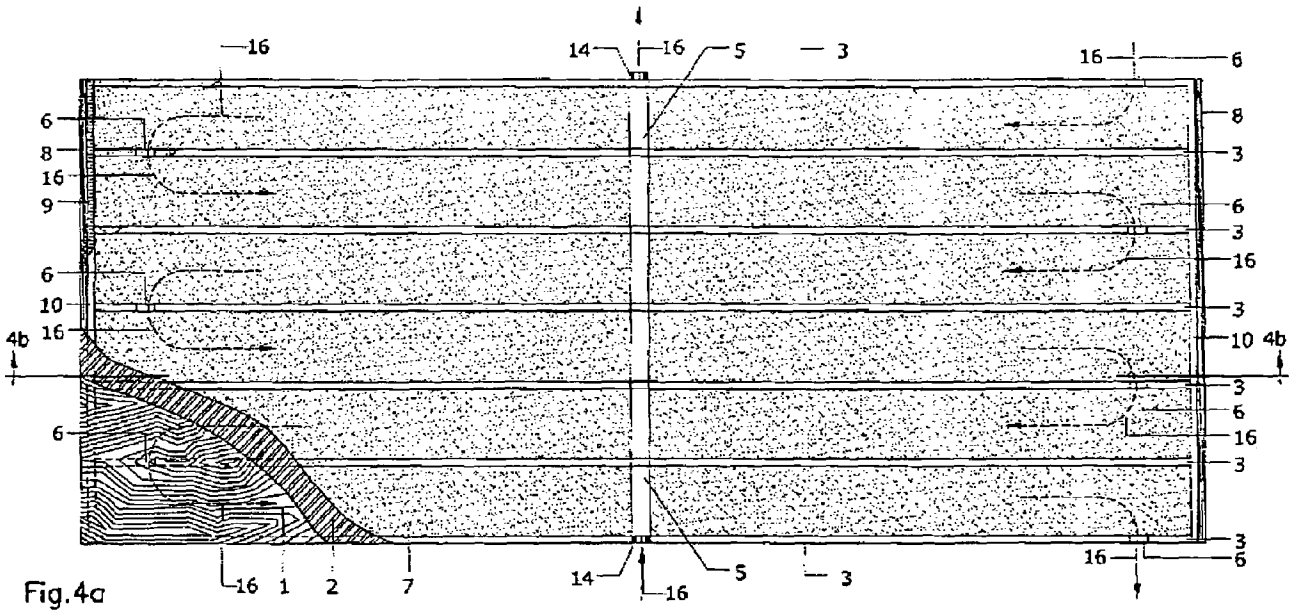
FIG. 4*a* is a fragmentary top plan view showing a standard floor panel assembly in accordance with the invention.
Figure 4B:
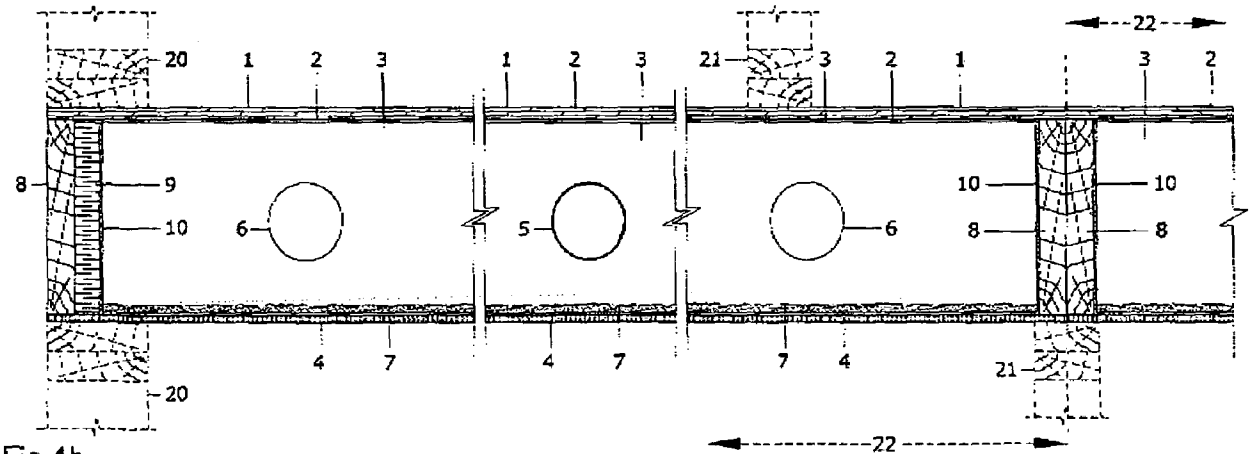
FIG. 4*b* is a fragmentary longitudinal sectional view showing a standard floor panel assembly in accordance with the invention.

As shown in FIGS. 4*a* and 4*b*, the edge floor panel with wood rim board (8) defines the possible division line for different heating zones (22). A panel duct joint (14) located at the interface between two panels provides an interlocking joint to position the adjacent panel in a designated location and connect the air supply duct (5) to the adjacent panel. In the case of a standard floor panel, the air supply duct passes through that panel and directly into the adjacent panel. Hot air is introduced into and exits the standard floor panel thorough the air circulation openings (6) connected to adjacent panels.

Figure 5A:
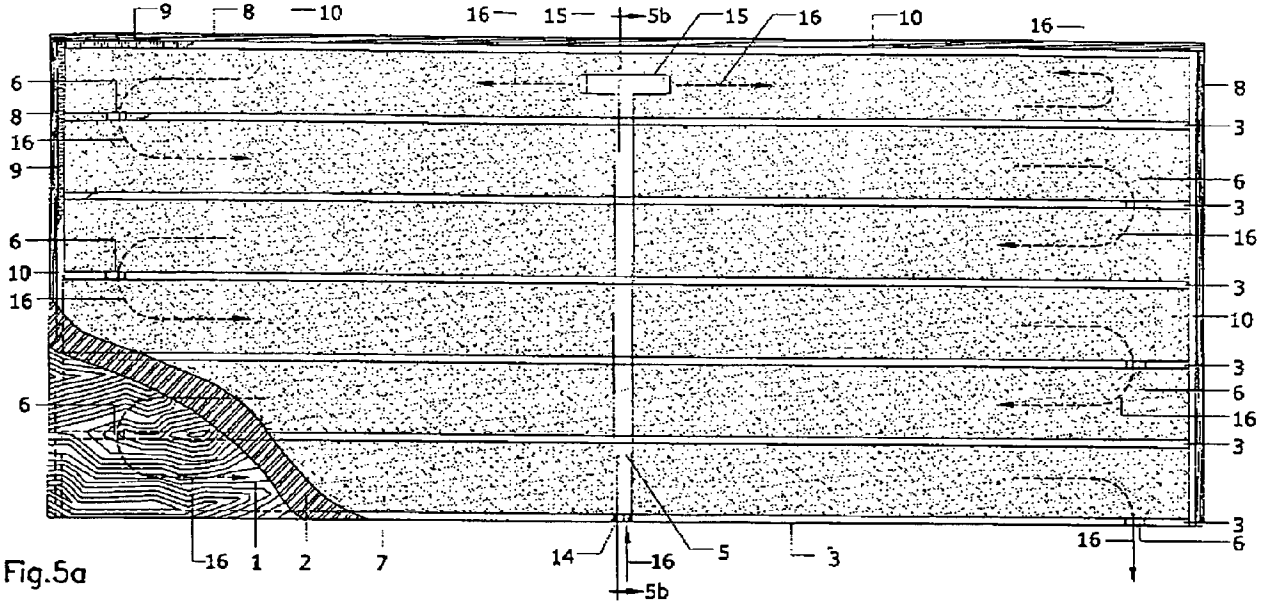
FIG. 5*a* is a fragmentary top plan view showing an end floor panel assembly in accordance with the invention.
Figure 5B:
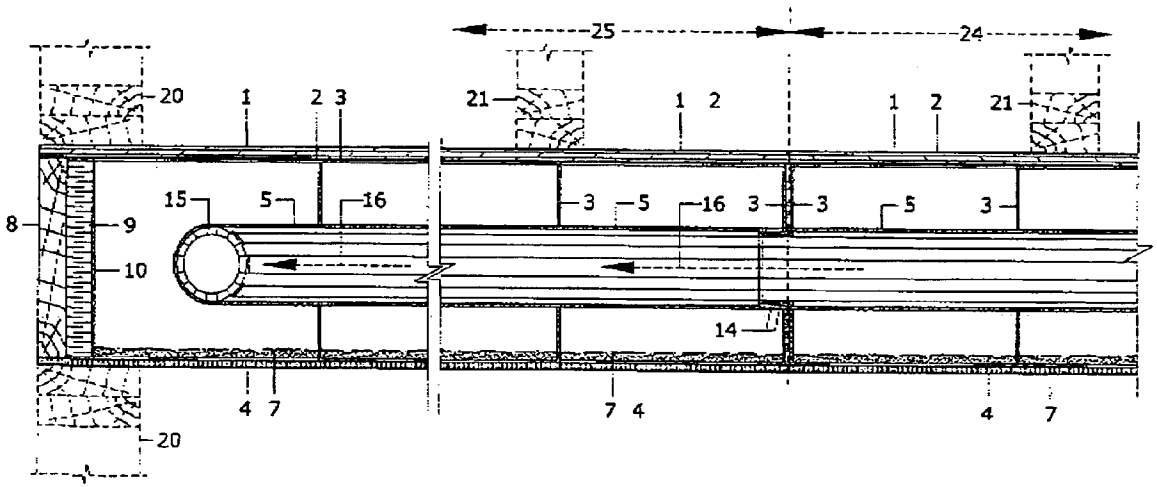
FIG. 5*b* is a fragmentary cross sectional view showing an end floor panel assembly in accordance with the invention.

As shown in FIGS. 5*a* and 5*b*, an air supply duct (5) within the end floor panel terminates at an air supply head (15) and sets up the starting point of energy (heat) convection within the cavities of the sealed floor panels for radiant in-floor heating. Hot air exists the end floor panel thorough an air circulation opening (6) connected to the adjacent panel.

FIGS. 3*b*, 4*b* and 5*b* show the wood rim board (8) with edge insulation (9) and metal rim joist (10), together which form the edge of the floor panel. Those figures also show a layer of thermal insulation (7) on the top of the enclosure board (4). The edge insulation (9) and thermal insulation (7) both reduce heat loss to the outside of the sealed floor system.

The present invention is an improved radiant in-floor heating system that employs a simple and effective structure to overcome the complexity, inefficiencies and cost disadvantages of existing in-floor heating systems and prior art utilising hot air. The present invention also minimises maintenance of the radiant in-floor heating system, as well as the floor construction complexity and installation time as compared to other radiant in-floor heating systems.

Various modifications and alterations of the present invention will be readily apparent to persons skilled in the art of building construction. It is intended, therefore, that the foregoing be considered as exemplary and that the scope of the invention be limited only by the following claims.

The invention claimed is:

1. A floor system for a building, said floor system comprising a sealed floor system in which a plurality of metal joists, having circulation openings, a sub-floor, a radiant metal sheet attached directly to the bottom of the sub-floor and disposed directly on top of said plurality of metal joists, wood rim boards with edge insulation, and a bottom enclosure board are arranged to form an internal airflow pathway for directing the circulation of heated air from a furnace and the convection of energy within the said sealed floor system is a combined radiant in-floor heating system and structural floor system.

2. The floor system of claim 1, wherein said plurality of metal joists absorb and store energy from the heated air, and conduct energy to said radiant metal sheet; and wherein said plurality of metal joists support a floor of the building.

3. The floor system of claim 1, wherein said radiant metal sheet said radiant metal sheet absorbs energy from the from heated air, conducts energy from said metal joists, and releases energy to said sub-floor.

4. The floor system of claim 1, wherein said bottom enclosure board has a layer of insulation disposed thereon.

5. The floor system of claim 1, wherein said internal air circulation openings; and wherein the said internal air circulation openings are positioned at opposite ends of each successive ones of said metal joists to create a one-way flow direction for the heated air within the airflow pathway.

6. The floor system of claim 1 further including air supply connections; and also including air return connections through which heated air is directed out of the sealed floor system.

7. The floor system of claim 1, wherein said floor system is prefabricated and modularised into one or more of three types of panels to match a desired building floor plan layout, the one or more of three types of panels being selected from the group consisting of: a utility floor panel, a standard floor panel, and an end floor panel.

* * * * *